US005387847A

United States Patent [19]

Wood

[11] Patent Number: 5,387,847

[45] Date of Patent: Feb. 7, 1995

[54] PASSIVE POWER FACTOR BALLAST CIRCUIT FOR THE GAS DISCHARGE LAMPS

[75] Inventor: Peter N. Wood, Rolling Hills Est., Calif.

[73] Assignee: International Rectifier Corporation, El Segundo, Calif.

[21] Appl. No.: 206,512

[22] Filed: Mar. 4, 1994

[51] Int. Cl.[6] ..... H05B 37/02

[52] U.S. Cl. ..... 315/209 R; 315/251; 315/272; 315/275; 315/187; 315/245; 315/238; 315/352

[58] Field of Search ..... 315/209 R, 251, 272, 315/275, 187, 245, 238, 352

[56] References Cited

U.S. PATENT DOCUMENTS

| | | | |
|---|---|---|---|
| 3,390,669 | 8/1968 | Hafton | 315/209 R |
| 3,553,528 | 9/1968 | Somlyody | 315/209 R |
| 4,075,476 | 2/1978 | Pitel | 315/209 R |
| 4,127,797 | 11/1978 | Perper | 315/209 R |
| 4,928,039 | 5/1990 | Nilssen | 315/209 R |
| 5,258,692 | 11/1993 | Jones | 315/209 R X |
| 5,315,214 | 5/1994 | Lesea | 315/209 R |

*Primary Examiner*—Robert J. Pascal
*Assistant Examiner*—Reginald A. Ratliff
*Attorney, Agent, or Firm*—Ostrolenk, Faber, Gerb & Soffen

[57] ABSTRACT

A ballast for a gas discharge lamp circuit has a d-c output which contains three series-connected diodes connected across the output terminals, a pair of capacitors connected from different respective nodes of the diodes to respective ones of the output terminals, and a resistor connected between two of the diodes. The resistor increases the circuit power factor to greater than 0.95.

24 Claims, 2 Drawing Sheets

PASSIVE POWER FACTOR BALLAST CIRCUIT FOR THE GAS DISCHARGE LAMPS

BACKGROUND OF THE INVENTION

This invention relates to power supply circuits for gas discharge lamps, and more specifically relates to such a power supply circuit having a power factor in excess of 0.95.

Electronic ballast circuits for gas discharge lamps are well known. Such circuits should have a power factor in excess of 0.95 for more efficient operation and to meet specifications of various organizations and municipalities.

A very inexpensive ballast circuit, manufactured and sold in the Peoples Republic of China, and identified as "Peking Radio Factory #5" employs a rectifier circuit to increase power factor. This circuit uses three diodes in series, having two capacitors each having one terminal connected to respective ones of the opposite end terminals of the string of diodes and their other terminals connected to respective nodes between the center diode and the outer two diodes of the three-diode chain. The outer ends of the diode chain are connected to the positive and negative output terminals to the lamp circuit. With this connection, the two capacitors will charge in series and discharge in parallel.

The power factor of this prior art circuit was measured to be 0.935. Thus, the circuit is not useful for the numerous applications requiring a power factor in excess of 0.95.

BRIEF DESCRIPTION OF THE INVENTION

In accordance with the present invention, a resistor is added to the rectifier circuit described above, between two of the diodes of the three-diode chain, specifically at the node between the resistor and the cathode terminal of one of the diodes.

The resistor, having a value of 47 ohms and 1 watt in the preferred embodiment of the invention increased the power factor of the circuit to 0.958. Other resistance values can be used which also will increase the circuit power factor.

The reason for the power factor improvement is that the added resistor changes the shape of the current waveform from a spike to a smoother change, in the step waveform, tending to bring the current wave shape more alignment with the sinusoidal voltage, therefore increasing the power factor.

DETAILED DESCRIPTION OF THE DRAWINGS

Figure 1:
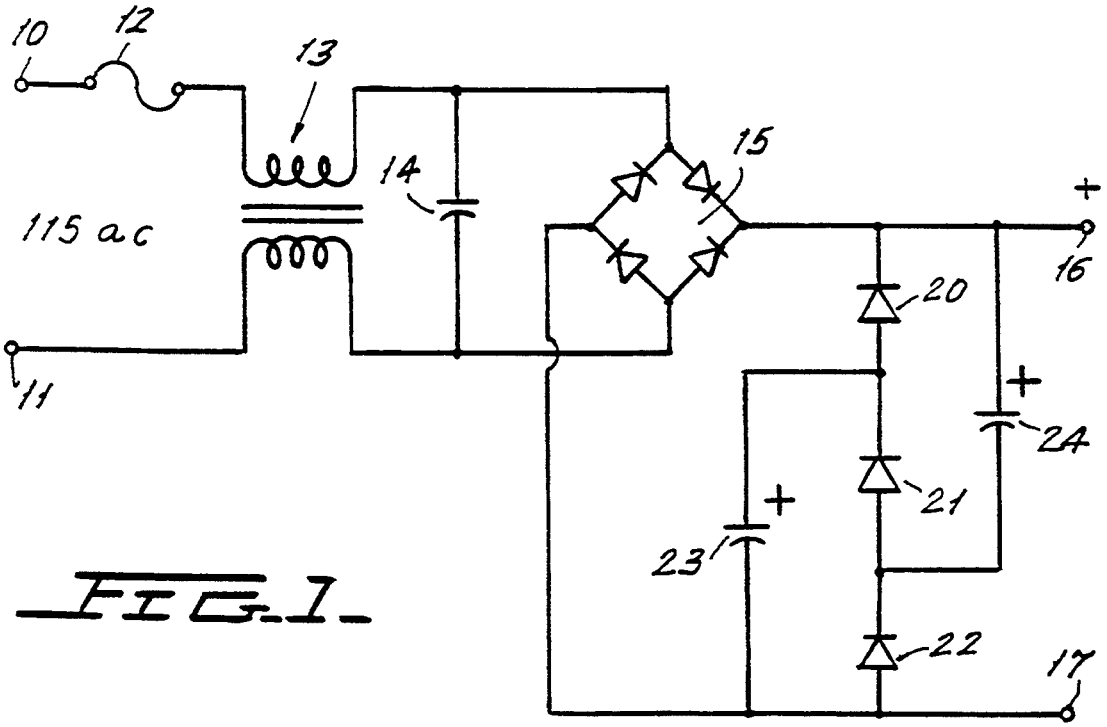
FIG. 1 is a circuit diagram of a prior art rectifier circuit.

FIG. 1 shows a prior art lamp ballast rectifier circuit, identified as a "Peking Radio Factory #5", and was made and sold in the Peoples Republic of China. The circuit of FIG. 1 could be used, for example, to drive up to a 100 watt fluorescent lamp with electronic ballast or other load.

The circuit of FIG. 1 has input a-c terminals 10 and 11 which are connectable to a 115 volt a-c source. Terminal 10 is connected to a 2 ampere fuse 12 and then a two-winding transformer 13 and capacitor 14 which act as a noise filter and keep voltage spikes from the ballast circuit from being applied to the a-c line. Capacitor 14 is 0.1 microfarad.

A single phase, full wave bridge rectifier 15 is connected to the terminals of capacitor 14 and its d-c terminals 16 and 17 provide a d-c output to a lamp circuit. The bridge 15 consists of four IN4007 diodes.

In order to increase power factor, a novel circuit is provided, consisting of three diodes 20, 21 and 22, poled with their cathodes conducting in the same direction, and two capacitors 23 and 24 connected as shown from lines 16 and 17, respectively, to the nodes between diodes 21-22 and 22-23, respectively. Diodes 20, 21 and 22 are each Type IN4007, and capacitors 23 and 24 are each 47 microfarads, 100 volt capacitors. Capacitors 23 and 24 charge in series, as the potential at terminal 16 increases, and discharge in parallel when that potential decreases.

The power factor of the circuit of FIG. 1 has been measured to be 0.935, which is too low for use in numerous applications requiring a power factor greater than 0.95.

Figure 2:
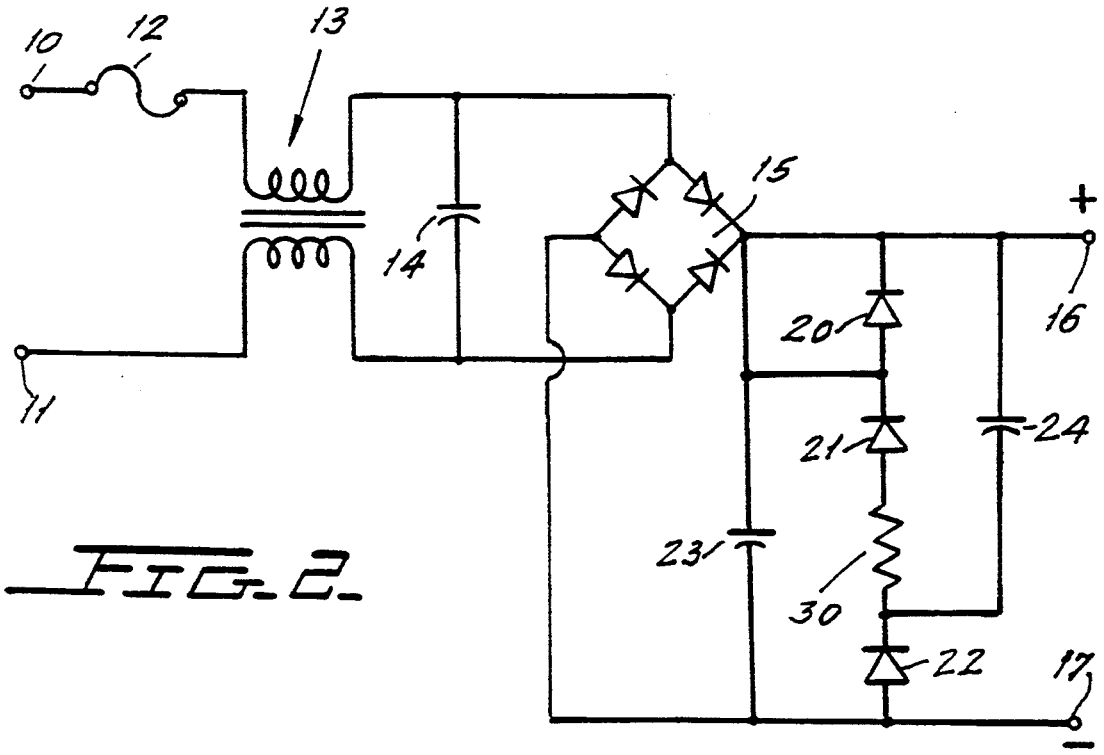
FIG. 2 is a circuit diagram of the circuit of FIG. 1, but incorporating the improvement of the present invention.

In accordance with the present invention, and as shown in FIG. 2, it has been found that the addition of an inexpensive resistor increases the power factor of the circuit above 0.95. Thus, in FIG. 2, where components which are the same those of FIG. 1 carry the same identifying numeral, a resistor 30 is added between diodes 21 and 22 and one terminal of capacitor 24 is connected to the node between diode 22 and resistor 30. In the preferred embodiment of the invention, resistor 30 is a 1 watt, 47 ohm resistor. Its presence increased the power factor of the circuit to 0.958, and above 0.95. Other resistance values could be used, in combination with other values for capacitors 23 and 24, to produce the desired result of a power factor greater than 0.95.

The resistor 30 acts to reduce the "spiking" of capacitors 23 and 24 during their operation to cause a more gradual current change which more closely matches the input voltage wave shape, thus leading to a higher power factor.

Thus, in operation, each of capacitors 23 and 24 charge in series to: $V_P/2-3V_F$.

where $V_P$ is the peak voltage at terminal and $V_F$ is the forward voltage drop of any of the diodes in bridge 15, and diodes 20, 21 and 22.

During discharge, capacitors 23 and 24 discharge in parallel to: $V_P/2-V_F$.

The minimum "valley" voltage on the output bus at terminal 16 is:

$$\frac{V_P}{2} - V_F - \frac{V_P}{2} e^{-\frac{t}{CR}}$$

where t is time, C is two times the capacitance of capacitor 23 or 24, R is the resistance of resistor 30 (made equal to $V_P/2I_O$, where $I_O$ is output current), and t=2.76 milliseconds for a 60 hertz input. The more gradual change in the rate of change of current or reduction of spiking thus increases the circuit power factor.

Figure 3:
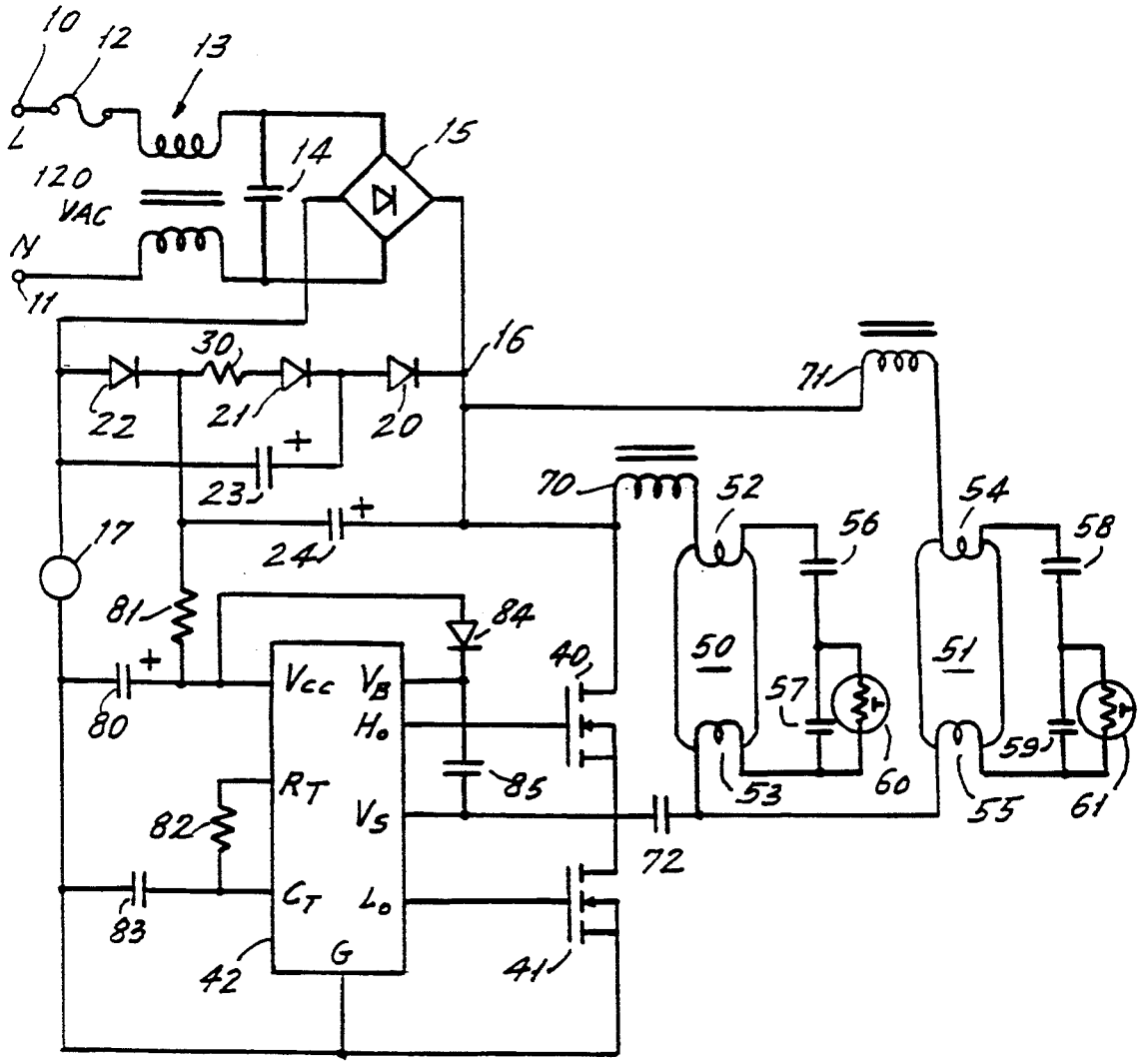
FIG. 3 is a circuit diagram of a one-half bridge high power factor ballast circuit for a double 40 watt fluorescent lamp circuit.

FIG. 3 shows the application of the novel circuit to a high power factor "Double 40" lamp circuit. In FIG. 3, those components which are the same as the components of FIG. 2 carry the same identifying numerals.

The circuit of FIG. 3 also contains a half bridge ballast containing a pair of power MOSFETs 40 and 41 which are turned on and off under the control of a MOS gate driver integrated circuit 42 which may be a Type IR2155 and MOSFETs 40 and 41 may be Types IRF624 for a 110 volt a-c input, or IRF730 for a 220 volt input a-c voltage.

The MOSFETs 40 and 41 are connected to drive two 40 watt fluorescent lamps 50 and 51 which have heater windings 52, 53 and 54, 55, respectively. A pair of capacitors 56, 57 and 58, 59 are in parallel with tubes 50 and 51, respectively, and thermistors 60 and 61 are in parallel with capacitors 57 and 59, respectively. Output terminal 16 is connected through inductors 70 and 71 to heater windings 52 and 54, respectively, while heater windings 53 and 55 are connected, through capacitor 72, to the node between power MOSFETs 40 and 41. Output terminal 16 is also connected to the drain electrode of MOSFET 40 and output terminal 17 is connected to the source electrode of MOSFET 41.

The MOS gate driver 42 is then connected to drive the power MOSFETs 40 and 41 near the natural frequency of oscillation of the circuit including the inductors 70 and 71 and the capacitors associated therewith. Thus, the $H_O$ (high output) pin is connected to the gate of MOSFET 40 and the $L_O$ (low output) pin is connected to the gate of MOSFET 41. Input power for the chip 42 is derived from terminal 17, through capacitor 80 to pin $V_{CC}$, and from resistor 81 which is connected to the node between diode 22 and resistor 30. Pins $R_T$ and $C_T$ are connected by resistor 82 and are connected to terminal 17 through capacitor 82. The $V_{CC}$ pin is connected to pin $V_B$ through diode 84 and to pin $V_S$ through capacitor 85.

In operation, the control circuit chip 42 will provide turn on signals alternately to power MOSFETs 40 and 41 such that lamps 50 and 51 are connected to the output terminals 16 and 17 when MOSFET 41 is on and MOSFET 40 is off and drive recirculating current through MOSFET 40 when it turns on and MOSFET 41 turns off. In this way, the tubes 50 and 51 are efficiently driven at a relatively high frequency, for example, 30 to 70 kilohertz, while the circuit exhibits a high power factor, in excess of 0.95 by virtue of the presence of resistor 30.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A high power factor power supply for a lamp ballast circuit; said power supply comprising, in combination:

a pair of input a-c terminals;

rectifier means having a-c and d-c terminals; said pair of input a-c terminals connected to said a-c terminals of said rectifier means; said pair of d-c terminals being connectable to a lamp ballast circuit;

a first, second and third diode connected in series with one another and being connected between said pair of d-c terminals;

a first and a second capacitor; said first capacitor being connected between one of said d-c terminals and the node between said first and second diodes; said second capacitor being connected between the other of said terminals and between said second and third diodes;

and a resistor connected between said second and third diodes; said second capacitor connected to the node between said resistor and said third diode.

2. The power supply of claim 1 wherein said power supply has a power factor in excess of 0.95.

3. The power supply of claim 1 which further includes a noise filter circuit connected across said pair of input a-c terminals.

4. The power supply of claim 1 wherein said rectifier means is a full wave bridge-connected rectifier.

5. The power supply of claim 1 wherein said first and second capacitors are identical to one another.

6. The power supply of claim 1 wherein said one of said d-c terminals is a positive terminal.

7. The power supply of claim 1 wherein said resistor has a value of about 47 ohms.

8. The power supply of claim 2 which further includes a noise filter circuit connected across said pair of input a-c terminals.

9. The power supply of claim 8 wherein said rectifier means is a full wave bridge-connected rectifier.

10. The power supply of claim 9 wherein said first and second capacitors are identical to one another.

11. The power supply of claim 10 wherein said one of said d-c terminals is a positive terminal.

12. The power supply of claim 7 wherein said one of said d-c terminals is a positive terminal.

13. In a power supply circuit for a lamp ballast circuit, in combination:

a pair of input a-c terminals;

rectifier means having a-c and d-c terminals; said pair of input a-c terminals connected to said a-c terminals of said rectifier means; said pair of d-c terminals being connectable to a lamp ballast circuit;

a first, second and third diode connected in series with one another and being connected between said pair of d-c terminals;

a first and a second capacitor; said first capacitor being connected between one of said d-c terminals and the node between said first and second diodes; said second capacitor being connected between the other of said terminals and between said second and third diodes;

the improvement which comprises a resistor connected between said second and third diodes; said second capacitor connected to the node between said resistor and said third diode; said circuit having a power factor in excess of 0.95.

14. The power supply circuit of claim 13 which further includes a noise filter circuit connected across said pair of input a-c terminals.

15. The power supply circuit of claim 14 wherein said rectifier means is a full wave bridge-connected rectifier.

16. The power supply circuit of claim 14 wherein said first, and second capacitors are identical to one another.

17. The power supply circuit of claim 15 wherein said one of said d-c terminals is a positive terminal.

18. The power supply circuit of claim 13 wherein said resistor has a value of about 47 ohms.

19. The power supply circuit of claim 17 wherein said resistor has a value of about 47 ohms.

20. A gas discharge lamp circuit comprising a high power factor power supply and a lamp ballast circuit; said high power factor power supply comprising, in combination:

a pair of input a-c terminals;

rectifier means having a-c and d-c terminals; said pair of input a-c terminals connected to said a-c terminals of said rectifier means; said pair of d-c terminals being connectable to a lamp ballast circuit;

a first, second and third diode connected in series with one another and being connected between said pair of d-c terminals;

a first and a second capacitor; said first capacitor being connected between one of said d-c terminals and the node between said first and second diodes; said second capacitor being connected between the other of said terminals and between said second and third diodes;

and a resistor connected between said second and third diodes; said second capacitor connected to the node between said resistor and said third diode; said ballast circuit comprising, in combination:

power MOSFET means for controlling the current flow to at least one gas discharge lamp means such that said current flow varies at a given frequency and a MOS gate driver chip connected to said at least one gas discharge lamp means connected to said power MOSFET means for turning said power MOSFET means on and off at a controlled frequency.

21. The gas discharge lamp circuit of claim 20 wherein said power supply has a power factor in excess of 0.95.

22. The gas discharge lamp circuit of claim 21 wherein said first and second capacitors are identical to one another.

23. The gas discharge lamp circuit of claim 22 wherein said one of said d-c terminals is a positive terminal.

24. The gas discharge lamp circuit of claim 23 wherein said resistor has a value of about 47 ohms.

* * * * *